US006330768B1

(12) United States Patent
Rodrigues

(10) Patent No.: US 6,330,768 B1
(45) Date of Patent: Dec. 18, 2001

(54) WINDOW STORM PANEL BRACE

(76) Inventor: Donald J. Rodrigues, 1790 Riverwood La., Coral Springs, FL (US) 33071

( * ) Notice: Subject to any disclaimer, the term of this patent is extended or adjusted under 35 U.S.C. 154(b) by 0 days.

(21) Appl. No.: 09/641,959

(22) Filed: Aug. 21, 2000

(51) Int. Cl.[7] ..... E06B 3/26

(52) U.S. Cl. ..... 52/202; 49/57; 49/463; 248/354.3

(58) Field of Search ..... 52/202, 127.2, 52/DIG. 12; 49/57, 62, 463; 248/200.1, 208, 354.3

(56) References Cited

U.S. PATENT DOCUMENTS

| | | | | |
|---|---|---|---|---|
| 1,820,950 | * | 9/1931 | Schulstadt . | |
| 2,543,175 | * | 2/1951 | Kilgore . | |
| 2,549,661 | * | 4/1951 | Carney . | |
| 2,622,285 | | 12/1952 | Roos | 52/202 |
| 2,794,217 | * | 6/1957 | Croft . | |
| 3,131,928 | * | 5/1964 | Whipple . | |
| 3,782,052 | * | 1/1974 | Vetovitz . | |
| 3,822,850 | * | 7/1974 | Elias . | |
| 4,101,036 | * | 7/1978 | Craig . | |
| 4,449,876 | * | 5/1984 | Glanton . | |
| 5,186,430 | | 2/1993 | Ellithorpe | 248/354.3 |
| 5,335,452 | | 8/1994 | Taylor | 49/463 |
| 5,487,243 | | 1/1996 | Hale | 52/202 |
| 5,673,883 | * | 10/1997 | Fugueroa, Jr. . | |
| 5,709,054 | * | 1/1998 | McGillivray . | |
| 5,722,206 | | 3/1998 | McDonald | 52/202 |
| 5,740,639 | | 4/1998 | Covington | 52/202 |
| 5,937,593 | * | 8/1999 | White . | |

* cited by examiner

*Primary Examiner*—Blair M. Johnson
(74) *Attorney, Agent, or Firm*—Alvin S. Blum

(57) ABSTRACT

A window is protected from storms by applying a rigid protective panel, such as a plywood sheet cut to size, to the window frame. The panel is held securely in place by one or more innovative elongate braces or bars that extend from one wall of the window opening to an opposed wall. The brace has a long body provided with a planar friction pad at each end. Each pad is angularly adjustable relative to the long axis of the body to conform to the angle of the wall for maximum contact. One of the friction pads is connected to the body by a spring-loaded connection that allows for a short reciprocating motion with the spring urging the pad away from the body. This enables the user to temporarily hold the panel in place with one hand, while pushing the brace in place with both pads engaging opposed walls in a panel holding position with the other hand. The brace is then more tightly and securely extended by advancing a threaded nut that forces the pad farther away from the body. The body may be a readily available timber cut to size.

7 Claims, 4 Drawing Sheets

WINDOW STORM PANEL BRACE

BACKGROUND OF THE INVENTION

This invention relates to methods and means for protecting windows from damage in windstorms, and more particularly to braces that hold covering panels against windows.

DESCRIPTION OF THE PRIOR ART

Windows are usually protected in preparation for a windstorm by fastening a rigid panel, such as plywood, to the outside wall over the window opening. Screw anchors may be permanently mounted in the wall to removably receive screws passing through the perimeter of the panel. Each panel with its screw holes must be fitted to a particular window with its matching anchors. Because the exact path of a hurricane is not predictable until shortly before it hits, one is often confronted with the task of matching the panels and then positioning the panels to align the fastener holes while the wind is blowing and the panel is acting like a sail. Placing and drawing up all the fasteners is awkward and time consuming, especially in wind, rain, and darkness. U.S. Pat. No. 5,673,883 issued Oct. 7, 1997 to Figueroa teaches a bar device that fits into a window opening and, by means of a turnbuckle, forces pads tightly against opposed walls defining the window opening. This holds the bar securely in place. Threaded rods attached to the bar extend outward. The panel is held over the window opening by fastening it to the bar by means of holes in the panel that correspond to the threaded rods. Nuts on the rods then draw the panel up tightly to the outside of the building. In storm conditions, positioning the panel onto the rods may be difficult.

SUMMARY OF THE INVENTION

It is accordingly an object of the invention to provide a means for securing a storm panel over a window that may be operated easily and rapidly under adverse conditions. It is another object that the means be easily installed without special skills. The device of the invention comprises a brace or bar that is held securely in place by cushioned pads that forcefully engage opposed walls that define the window opening. The storm panel fits recessed in the opening against the window frame and it is held in place by one or more braces pressed against the face of the panel away from the window. Because all the windows in a house will ordinarily be of only a few standard dimensions, simple plywood panels cut to those dimensions may be used. There are no holes in the panels, so all the panels of the same dimensions may be used interchangeably. Braces with corresponding dimensions are also prepared in advance. There are no problems with aligning holes and applying fasteners. Each brace is spring loaded. It may be inserted in place against a panel with one hand. This makes it possible for one person to lift the panel into place with two hands, and then, while holding the panel with one hand, push the spring loaded brace in place with the other hand. After it is in place, it is forced tightly against the side walls by tightening a nut. These and other objects, features, and advantages of the invention will become more apparent when the detailed description is studied in conjunction with the drawings in which like elements are designated by like reference characters in the various drawing figures.

DETAILED DESCRIPTION OF PREFERRED EMBODIMENTS

Figure 2:
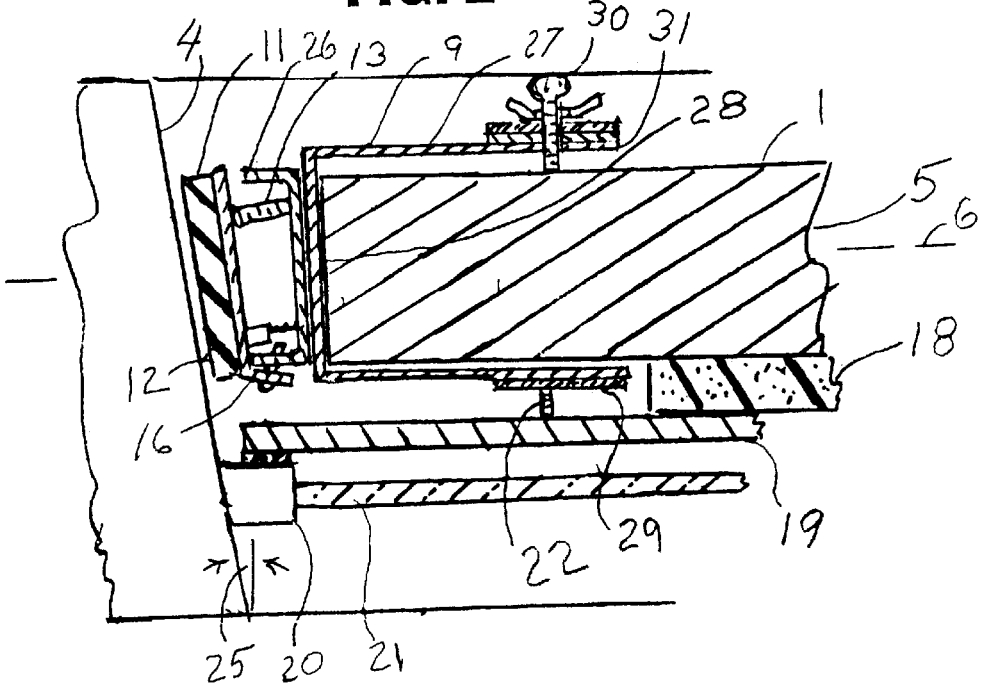
FIG. 2 is a sectional view taken through line 2—2 of FIG. 1.
Figure 1:
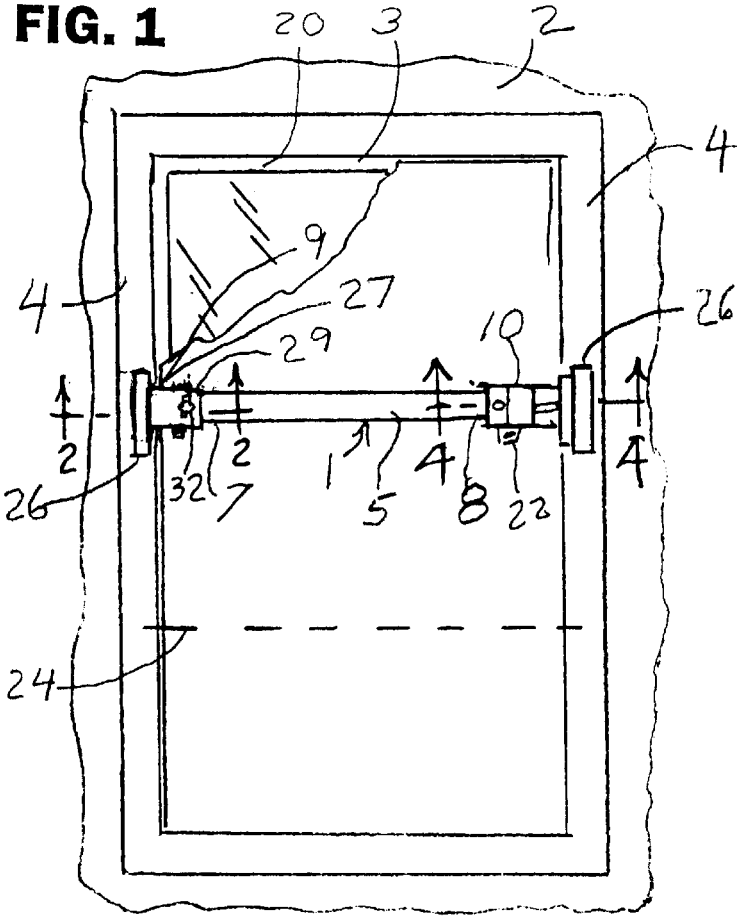
FIG. 1 is a front elevation view of a window with a brace of the invention holding a plywood panel (partially broken away) against the window.
Figure 3:
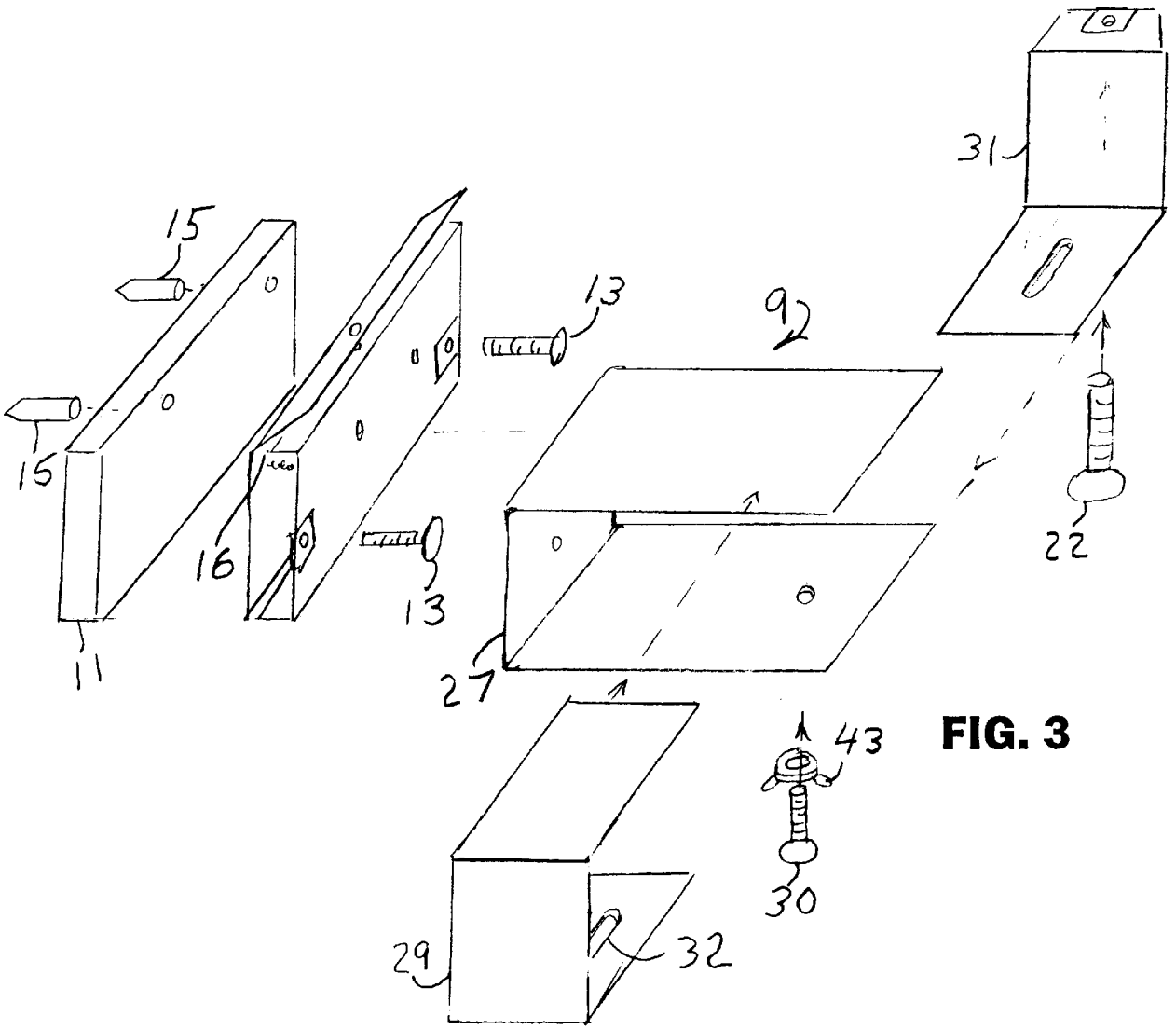
FIG. 3 is an exploded perspective view of FIG. 2.
Figure 4:
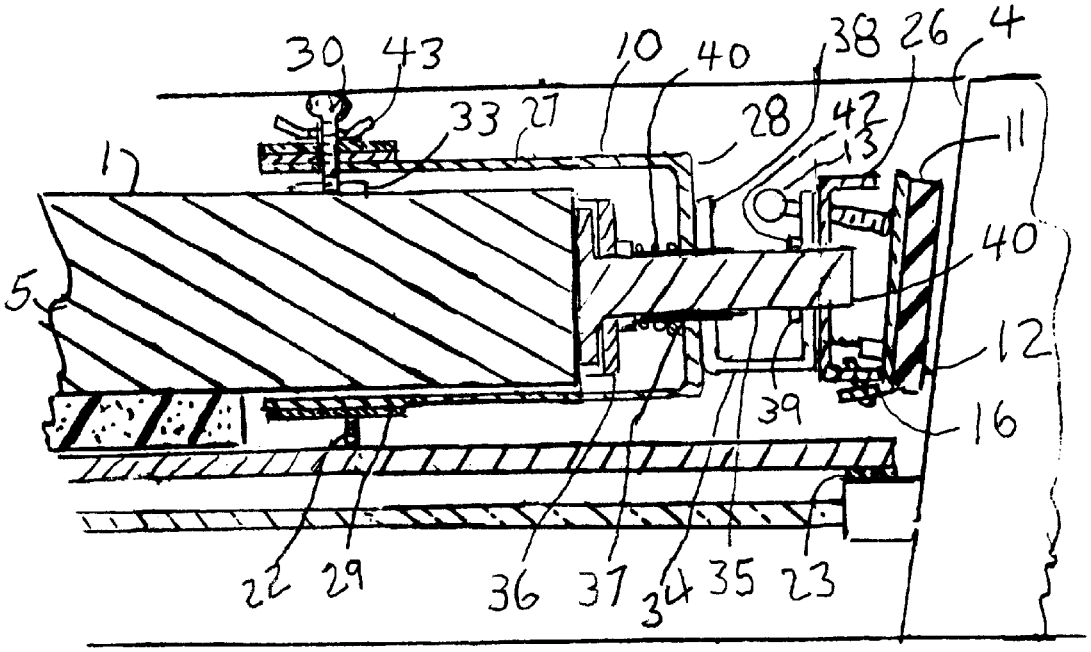
FIG. 4 is a sectional view taken through line 4—4 of FIG. 1.
Figure 5:
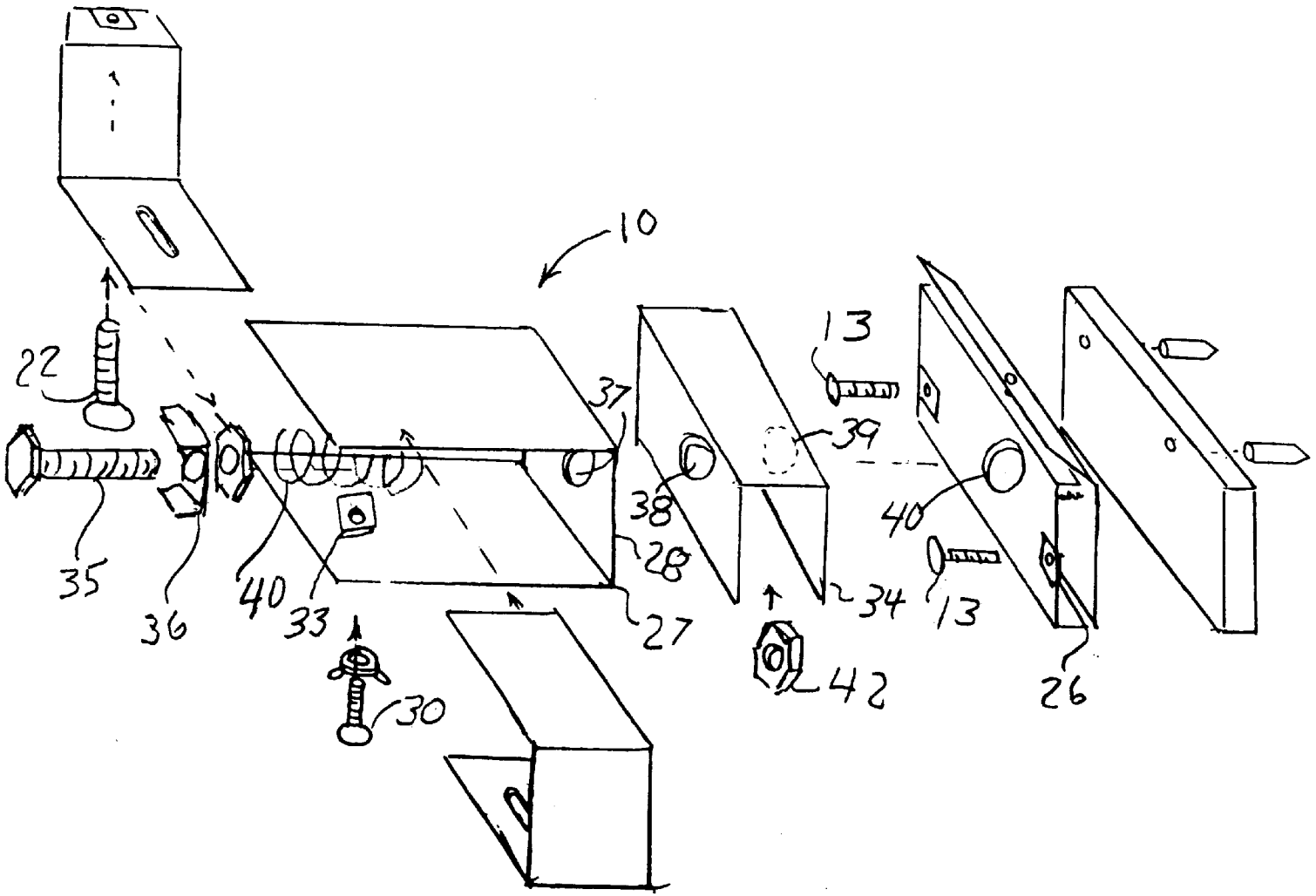
FIG. 5 is an exploded perspective view of FIG. 4.

Referring now to the drawing FIGS. 1–5, a usual window opening 3 in a building 2 is defined by parallel opposed walls 4. Although they may be orthogonal to the outer wall, they generally slope inwardly at an angle 25 of 5 or 10 degrees. Within the opening is a window frame 20 supporting glass 21. In order to protect against a storm, a rigid panel 19, generally of plywood, is cut to fit into the opening and rest against the frame. A resilient sealing strip 23 may be applied to the panel to seal it against the frame 20. A bar or brace 1 is used to securely hold the panel in place. Depending on the dimensions of the window, a second brace may be required, such as at phantom line 24. More braces may be used as desired. In some situations, one may apply the braces vertically.

The brace 1 comprises an elongate body 5, extending along long axis 6, with first end 7 and second end 8, that is preferably cut to required length from a piece of 2"×3" or 2"×4" lumber at the same store where the panel is cut. Materials other than wood may be used. The user need only make the required measurements, the lumber dealer will generally do the actual cutting. There are: no holes to drill; no fasteners to lose; and no matching of holes during deployment. The brace 1 has a friction pad assembly 26 attached to ends 7 and 8 by end assemblies 9 and 10 respectively. Each friction pad assembly 26 applies a planar resilient cushion 11 that may have hardened steel pointed pins 12 and/or a high friction surface to one of the opposed walls 4 of the window opening. The friction pad assembly is provided with angle adjustment means including thumbscrews 13 and spring loaded hinge means 16 for fixing the angle of the pad relative to the long axis 6 to cause it to lie flat against the wall 4 for maximum holding power. In the usual case, it will be found that the angle of adjustment will be substantially the same for all of the windows in a home. The rigid panels 19 and the bodies 5 for all of the windows are cut to size, and the angle adjustments are made at the time of installation.

Referring now to the first end assembly 9, it has a U-channel 27 with its central portion 28 affixed to the friction pad assembly 26. The two legs of channel 27 are held against body 5 by C-clamp 29 and thumbscrew 30 directly engaging the body. An angle element 31 threaded to receive the thumbscrew 30. Overlying C-clamp 29 is provided with a slot 32 to pass the thumbscrew 30 to enable clamp 29 and element 31 to move relative to one another to adjustably tighten against either a 2×3 or a 2×4, with wingnut 43 locking the adjustments, thus tightly affixing the end assembly to the body.

Referring now to the second end assembly 10, a similar means is provided for clamping the second end assembly 10 to either a 2×3 or 2×4 timber. However, thumbscrew 30 does not directly engage the body. Instead, it terminates in plate 33 that may be adjusted to enable a sliding fit on the body. The friction pad assembly 26 is not directly fastened to the center portion of U-channel 27. Instead a second channel 34 is interposed, with one of its parallel, opposed flanges affixed to center portion 28, and the other to the assembly 26. A sturdy threaded bolt 35 has a plate 36 with turned up edges that holds the bolt head captive to prevent bolt rotation. The bolt 35 passes through aligned holes 37, 38, 39, 40 in center portion 28, first and second opposed flanges of second channel 34, and friction pad assembly 26, respectively. A compression spring 40 urges the end assembly 10 away from the body. Pressure on the pad assembly, as it is forced against a wall 4, compresses the spring and shortens the overall length of the brace to enable it to fit into the opening 3 with the first end swung into place. When the brace is released, it will remain in place by spring bias, thereby holding the storm panel in position. Any angle adjustment with thumbscrews 13 may be done at this time. Now the brace may be tightly secured in place by slowly increasing its length beyond that due to the spring 40. This is accomplished by turning nut 42 against the second flange of channel 34 with a wrench to force the head of the bolt more tightly against the end of body 5. To press the brace against the panel 19 and prevent vibration of the panel, a strip of resilient foam rubber 18 may be cemented to the body 5. Thumbscrews 22, held captive on C-clamp 29, may also be provided to adjustably press against panel 19 to minimize vibration. The brace may further comprise a locking cover for protectively covering the nut to prevent unauthorized removal.

The method of the invention comprises:

a) providing a rigid protective panel dimensioned to fit against the window frame;

b) providing at least one brace having;

1) an elongate body having a long axis and first and second ends;

2) a first end assembly affixed to the first end and terminating in a high-friction planar pad that is angularly adjustable for lying flat against a first opposed wall of the window opening;

3) a second end assembly connected to the second end and terminating in a high-friction planar pad that is angularly adjustable for lying flat against a second opposed wall of the window opening, the assembly constructed to enable the pad to reciprocate along a short path parallel to the long axis;

4) spring bias means urging the pad of the second end assembly away from the body; and 5) fixing means for stopping reciprocating motion and forcing the pad of the second end assembly away from the body to tightly press the pads against the first and second opposed walls of the window opening, thereby tightly holding the brace in place in the window opening against the protective panel;

c) applying the panel to the window frame;

d) applying the planar pad of the second end assembly against a first opposed wall;

e) forcing the body toward the first opposed wall against the spring bias means to shorten the length of the brace to enable the second end assembly to be applied to the second opposed wall with the brace applying pressure against the panel to temporarily hold the panel in place; and f) applying the fixing means thereby stopping reciprocating motion and forcing the pad of the second end assembly away from the body to tightly press the pads against the first and second opposed walls of the window opening, thereby tightly holding the brace in place in the window opening against the protective panel.

The above disclosed invention has a number of particular features which should preferably be employed in combination, although each is useful separately without departure from the scope of the invention. While I have shown and described the preferred embodiments of my invention, it will be understood that the invention may be embodied otherwise than as herein specifically illustrated or described, and that certain changes in form and arrangement of parts and the specific manner of practicing the invention may be made within the underlying idea or principles of the invention.

What is claimed is:

1. A brace for removably pressing a rigid protective panel against a window frame within a window opening in a building, in which the opening is defined by opposed walls, the brace comprising:

a) an elongate body having a long axis and first and second ends;

b) a first end assembly affixed to the first end and terminating in a cushioned, high-friction planar pad that is angularly adjustable for lying flat against a first opposed wall of the window opening;

c) a second end assembly connected to the second end and terminating in a high-friction planar pad that is angularly adjustable for lying flat against a second opposed wall of the window opening, the second end assembly constructed to enable the respective pad to reciprocate along a short path parallel to the long axis;

d) spring bias means urging the pad of the second end assembly from the body; and e) fixing means for stopping reciprocating motion and forcing the pad of the second end assembly away from the body to tightly press the pads against the first and second opposed walls of the window opening, the brace for being held in place in the window opening and pressing the protective panel against the window frame.

2. The brace according to claim 1 further comprising means for fixing the angular adjustment of the pads.

3. The brace according to claim 1, in which said elongate body is an elongate wooden bar, and the first and second end assemblies are constructed to mount upon said wooden bar.

4. The brace according to claim 1 further comprising resilient means for bearing against the protective panel to inhibit panel motion, said resilient means being mounted on the elongate body.

5. The brace according to claim 1 further comprising adjustable means for pressing against the protective panel after the brace is installed to inhibit panel motion, said adjustable means being mounted on the first and second end assemblies.

6. A brace which is used to removably hold a rigid protective panel against a window frame within a window opening in a building, in which the opening is defined by opposed walls, the brace comprising:

a) an elongate body having a long axis and first and second ends;

b) a first end assembly affixed to the first end and terminating in a cushioned, high-friction planar pad that is angularly adjustable for lying flat against a first opposed wall of the window opening;

c) a second end assembly connected to the second end and terminating in a high-friction planar pad that is angularly adjustable for lying flat against a second opposed wall of the window opening, the assembly constructed to enable the pad to reciprocate along a short path parallel to the long axis;

d) spring bias means urging the pad of the second end assembly away from the body;

e) fixing means for stopping reciprocating motion and forcing the pad of the second end assembly away from the body to tightly press the pads against the first and second opposed walls of the window opening, thereby tightly holding the brace in place in the window opening against the protective panel; and f) resilient means for bearing against the protective panel to inhibit panel motion, said resilient means being mounted on the elongate body.

7. A method for covering a window for storm protection in which at least one brace is used to removably hold a rigid protective panel against a window frame within a window opening in a building, in which the opening is defined by opposed walls, the method comprising:

a) providing a rigid protective panel dimensioned to fit against the window frame;

b) providing at least one brace having;

1) an elongate body having a long axis and first and second ends;

2) a first end assembly affixed to the first end and terminating in a high-friction planar pad that is angularly adjustable for lying flat against a first opposed wall of the window opening;

3) a second end assembly connected to the second end and terminating in a high-friction planar pad that is angularly adjustable for lying flat against a second opposed wall of the window opening, the assembly constructed to enable the pad to reciprocate along a short path parallel to the long axis;

4) spring bias means urging the pad of the second end assembly away from the body; and 5) fixing means for stopping reciprocating motion and forcing the pad of the second end assembly away from the body to tightly press the pads against the first and second opposed walls of the window opening, thereby tightly holding the brace in place in the window opening against the protective panel;

c) applying the panel to the window frame;

d) applying the planar pad of the second end assembly against a first opposed wall;

e) forcing the body toward the first opposed wall against the spring bias means to shorten the length of the brace to enable the second end assembly to be applied to the second opposed wall with the brace applying pressure against the panel to temporarily hold the panel in place; and f) applying the fixing means thereby stopping reciprocating motion and forcing the pad of the second end assembly away from the body to tightly press the pads against the first and second opposed walls of the window opening, thereby tightly holding the brace in place in the window opening against the protective panel.

* * * * *